US006408603B1

(12) United States Patent
Babuik

(10) Patent No.: US 6,408,603 B1
(45) Date of Patent: Jun. 25, 2002

(54) TAIL SET

(76) Inventor: Richard Douglas Babuik, 62 Patterson Drive, Regina, Saskatchewan (CA), S4S 3W9

( * ) Notice: Subject to any disclaimer, the term of this patent is extended or adjusted under 35 U.S.C. 154(b) by 0 days.

(21) Appl. No.: 09/604,396

(22) Filed: Jun. 27, 2000

(51) Int. Cl.[7] ..... B68B 1/00; B68B 5/04
(52) U.S. Cl. ..... 54/78; 54/22
(58) Field of Search ..... 119/850, 712, 119/714, 809, 811; 54/78, 22

(56) References Cited

U.S. PATENT DOCUMENTS 1,991,299 A * 5/1935 Swaggerty ..... 54/22
2,508,117 A * 5/1950 Lavery, Sr. ..... 54/78
3,534,527 A * 10/1970 Miller ..... 54/78
3,736,906 A * 6/1973 Peterson ..... 119/712
3,827,403 A * 8/1974 Meyer ..... 119/712
4,141,197 A * 2/1979 Nichols ..... 54/22
4,969,917 A * 11/1990 Prue ..... 119/712
4,972,660 A * 11/1990 Black ..... 54/78
6,085,499 A * 7/2000 Mead-Lewis ..... 54/22

* cited by examiner

*Primary Examiner*—Charles T. Jordan
*Assistant Examiner*—Judith A. Nelson
(74) *Attorney, Agent, or Firm*—Ryan W. Dupuis; Adrian D. Battison; Michael R. Williams

(57) ABSTRACT

A tail set is provided for supporting a horse's tail thereon such that the tail is supported in a raised elevational and aligned straight with the horse's back for improved appearance of show horses. The tail set of the present invention is arranged to be secured to conventional bustle harnessing on the horse. The tail set includes a support member arranged to position the tail set on the horse's hindquarters and a curved trough rigidly supported on the support member for supporting the tail therein. The trough secures the tail between respective side members thereof to correct the tail of undesirable lateral deviations.

20 Claims, 3 Drawing Sheets

TAIL SET

FIELD OF THE INVENTION

This invention relates to a tail set for supporting a tail of a horse thereon and more particularly to a tail set which is secured to the horse by a harness.

BACKGROUND

When displaying show horses, it is desirable, to improve the appearance of the tail of the horse to ensure that the tail has a high elevation while being aligned straight with the horse's back. To ensure that the tail is properly set for shows, various training devices are used to prior to displaying the horse for correcting undesirable deviations of the tail.

One known tail set device comprises a harness having a strap which is looped under the horse's tail for supporting a pad known as a crupper under the tail of the horse. The harness also includes straps about a back, chest and belly of the horse, however this is generally not sufficient to adequately position the crupper for proper tail correction. Also, the crupper does not provide sufficient lateral support to the tail to correct lateral deviations thereof.

Another tail set device known as a bustle comprises a padded strap which is looped under the horse's tail in place of the crupper. The bustle engages respective sides of the horse's tail to provide more support than the crupper, however the resilient padding is not sufficient to adequately correct lateral deviations of the tail or support the tail in sufficiently raised elevation as desired.

SUMMARY

According to the present invention there is provided a tail set apparatus for supporting a tail of a horse, the apparatus comprising:

- a trough having a base along a bottom side thereof arranged to extend longitudinally from a first end to a second end of the trough, the trough including side members extending upwardly from respective sides of the base to extend longitudinally therewith so as to receive a portion of the tail of the horse extending through the trough from the first end to the second end securely between the respective rigid side members thereof;
- a support member having an outer surface mounting the first end of the trough thereon and an inner supporting surface opposite the outer surface, the inner supporting surface being oriented to span transversely to a longitudinal direction of the trough wherein at least a portion of the inner supporting surface is offset laterally outward from each side of the trough and at least a portion of the inner supporting surface is offset vertically from the first end of the trough so as to support the trough on a rear end of the horse to project outwardly therefrom when the inner supporting surface is engaged on the rear end of the horse; and
- a plurality of strap mounts mounted on the outer surface of the support member, each strap mount being arranged to secure a harness strap thereon wherein at least one strap mount is offset laterally from each side of the trough such that the trough is suspended from the strap mounts therebetween for supporting the trough on the horse.

The configuration of the support member ensures that the tail set is properly positioned on the hindquarters of the horse while the trough provides lateral support to secure the tail therein. The side members of the trough ensure that the tail is properly aligned with the hindquarters of the horse unlike any previously known device. The resulting horse tail when supported in the tail set according to the present invention is thus supported in raised elevation by the base of the trough while being corrected of any lateral deviations.

The trough may be arched in the longitudinal direction from the first end to the second end thereof. Preferably, the trough is curved downwardly and outwardly from the outer surface of the support member.

The side members of the trough may be arranged to extend upwardly to respective free ends which are parallel and spaced apart from each other. This provides sufficient support for securing the tail therebetween while correcting the tail of lateral deviations.

In one arrangement, the support member comprises two lobes, each lobe extending laterally outward from a respective side of the trough. The lobes are preferably spaced apart with the inner supporting surface of each lobe being generally concave in shape.

Preferably the support member is generally symmetrical about a vertical plane extending longitudinally with the trough so as to evenly balance the support member on the rear end of the horse.

The base of the trough is preferably spaced outwardly from the inner supporting surface of the support member. In this arrangement, the trough does not interfere with the bowel movements of the horse in use.

The support member preferably spans both upward and downward from the first end of the trough so as to adequately support the trough with the weight of the tail thereon to extend outwardly from the rear end of the horse.

A cap may be arranged to be mounted on the trough spaced from the base thereof so as to secure the tail of the horse between the cap and the base of the trough. The cap is preferably hinged along one side thereof on one of the side members of the trough so as to be arranged to fully enclose a top side of the trough when engaged thereon.

Preferably at least one of the strap mounts is mounted on the support member offset upwardly from the first end of the trough to provide vertical support to the trough.

There may provided one strap mount spaced above the trough and one strap mount spaced below the trough offset laterally from each side of the trough to ensure that the support member is statically positioned on the rear end of the horse in use.

When, the support member comprises a pair of spaced apart lobes there may be provided an adjustable strap member coupled therebetween spaced above the trough.

The trough is preferably formed of rigid material wherein there is provided a lining along an inner surface of the trough formed of resilient padded material to comfortably support the tail thereon.

There may further be provided a lining along the inner supporting surface of the support member formed of resilient padded material to comfortably support the tail set on the rear end of the horse.

BRIEF DESCRIPTION OF THE DRAWINGS

In the accompanying drawings, which illustrate an exemplary embodiment of the present invention.

DETAILED DESCRIPTION

Figure 1:
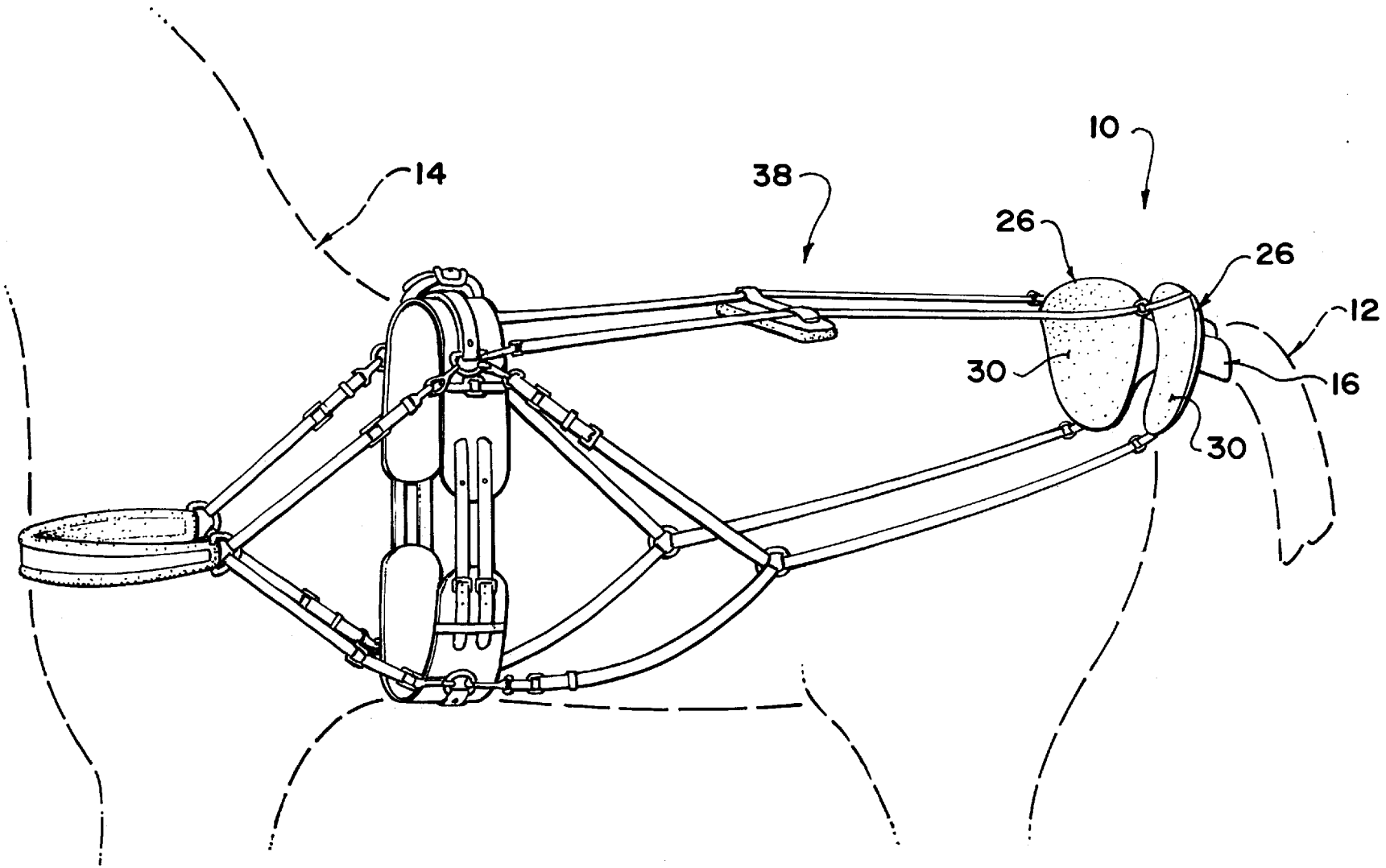
FIG. 1 is an isometric view of the tail set of the present invention shown coupled to conventional harnessing for supporting the tail set on a horse.
Figure 2:
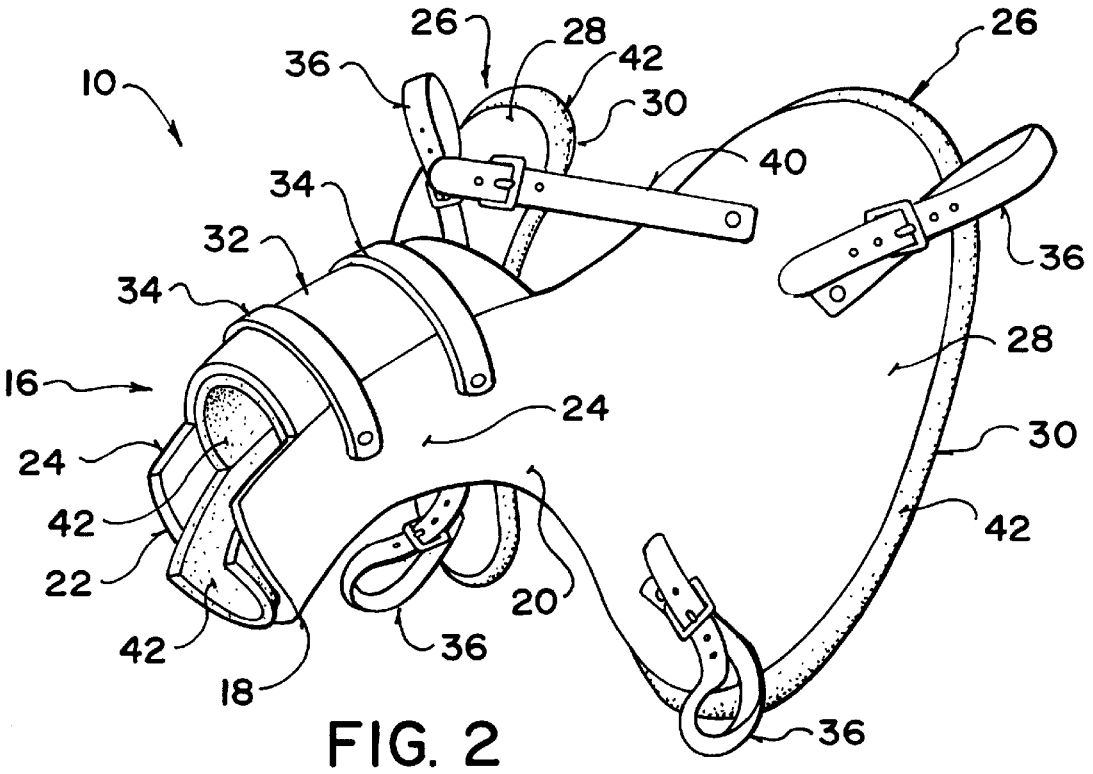
FIG. 2 is an enlarged isometric view of the tail set of FIG. 1.
Figure 3:
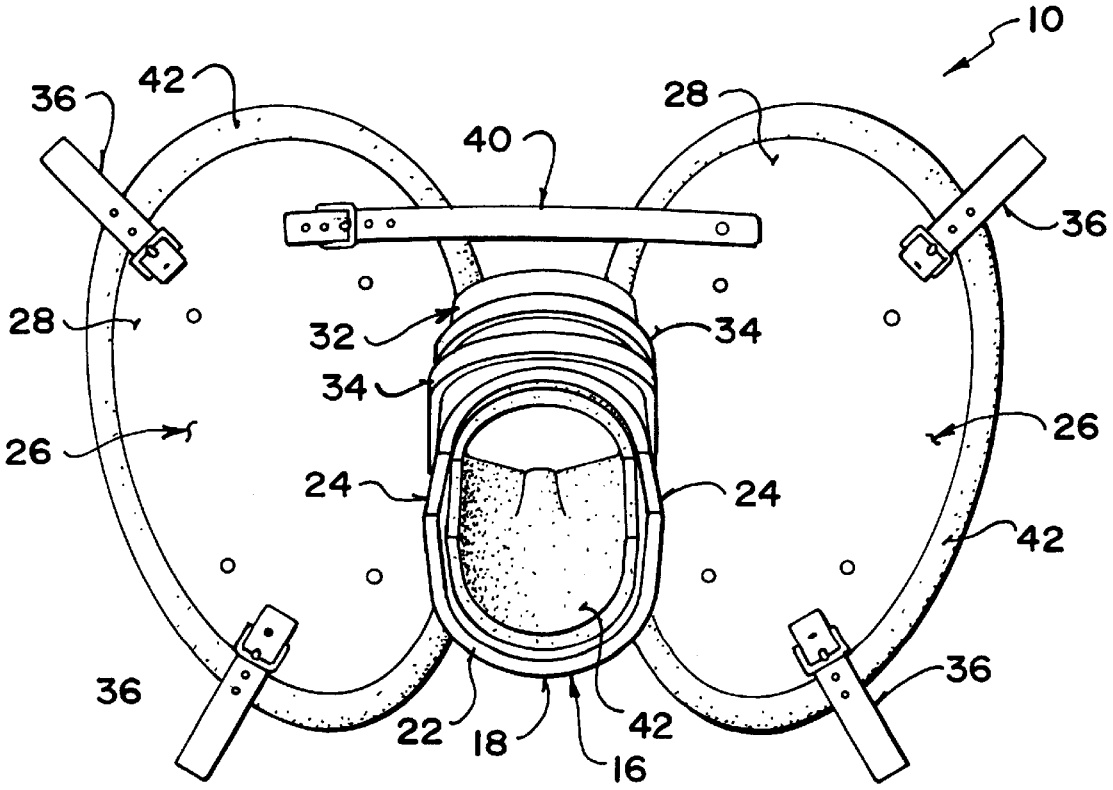
FIG. 3 is a rear elevational view of the tail set of FIG. 1.

Referring to the accompanying drawings, there is illustrated a tail set generally indicated by reference numeral 10. The tail set 10 is a training device arranged to support the tail 12 of a horse 14 therein in raised elevational while correcting the tail of undesirable lateral deviations. The tail set 10 is supported on the horse during training and prior to displaying the horse at shows and the like for improving the appearance of the horse.

The tail set 10 includes a trough 16 having a base 18 which extends longitudinally from a first end 20 to a second end 22 of the trough. Rigid side members 24 curve upwardly from respective sides of the base 18 to respective free ends which are generally parallel to each other and spaced apart. The trough 16 is arched in a longitudinal direction to extend outwardly in a downward curve from the first end to the second end thereof.

The first ends of the respective side members 24 each mount a padded lobe 26 thereon. Each lobe 26 includes a domed outer surface 28 which is rigidly connected to the trough. The lobes 26 each further include an inner supporting surface 30 opposite the respective outer surfaces 28 which is generally concave in shape and spans transversely to the longitudinal direction of the trough. The lobes 26 are spaced apart while the base 18 of the trough is spaced outwardly from the respective inner supporting surfaces 30 such that there is no anal interference with the horses bowel movements.

Each lobe 26 is generally oval in shape so as to define a support member which is generally symmetrical about a vertical plane extending longitudinally with the trough. At least a portion of the respective inner supporting surfaces 30 are arranged to span above below and laterally outwardly from each side of the trough to evenly and comfortably support the trough on opposing hindquarters of the horse.

A cap 32 is provided in the form of an inverted trough for mounting on a top side of the trough 16 to engage the tail of the horse between the cap 32 and the base 18 of the trough. The tail is thus secured between the respective side members 24 of the trough. The cap 32 mates with the trough 16 to form a tubular enclosure which fully surrounds the horses tail 12 in use. A pair of cap straps 34 are anchored on one of the side members 24 of the trough and secure the cap 32 thereon such that the straps 34 act as a hinge mounting the cap on the trough. The straps 34 are further arranged to extend over the cap and latch onto the other side member 24 of the trough to secure the cap in an enclosed position with the horses tail therein in use. The cap 32 is curved similarly to the trough 16 so as to match the contours thereof.

A plurality of strap mounts 36 are mounted on the outer surface 28 of the lobes 26 for securement to conventional bustle harnessing generally indicated by reference numeral 38 in FIG. 1. Each strap mount 36 includes a buckle and strap arranged to be secured to the bustle harnessing 38. One of the strap mounts 36 is spaced above and below the trough, offset laterally from each side thereof to suspend the trough therebetween from the mounts in use. The two uppermost strap mounts 36 support most of the weight of the tail set 10 thereon while the lower most strap mounts 36 assist in laterally positioning the tail set statically on the rear end of the horse. An additional adjustable strap 40 is coupled to extend between the respective lobes 26 at a position spaced above the trough 16.

The rigid trough 16 is lined with resiliently padded felt 42 which is formed to match the contours of the trough and cap respectively so as to comfortably secure the tail of the horse therebetween. The felt 42 is arranged to extend longitudinally past the respective ends of the base 18 and the cap 32 so as to prevent abrasion of the tail thereon. The inner supporting surface 30 of each lobe 26 is also lined with resiliently padded felt for engaging the rear end of the horse and comfortably supporting the tail set 10 thereon.

Figure 5:
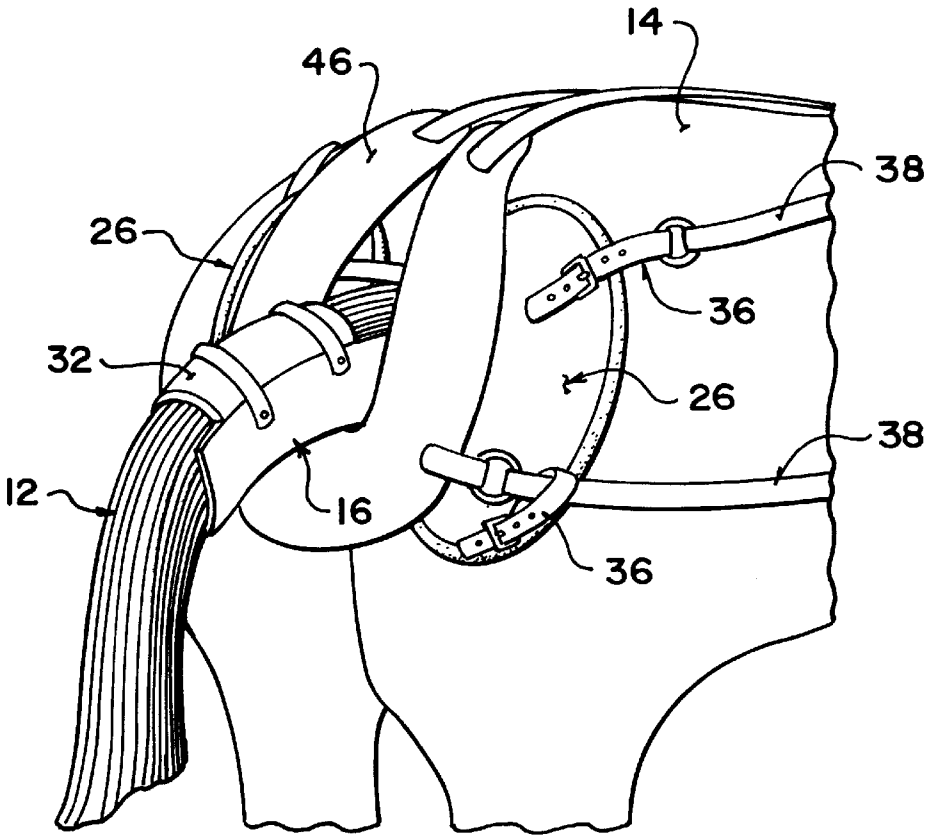
FIG. 5 is an isometric view of the tail set shown mounted on a horse in conjunction with a bustle.
Figure 4:
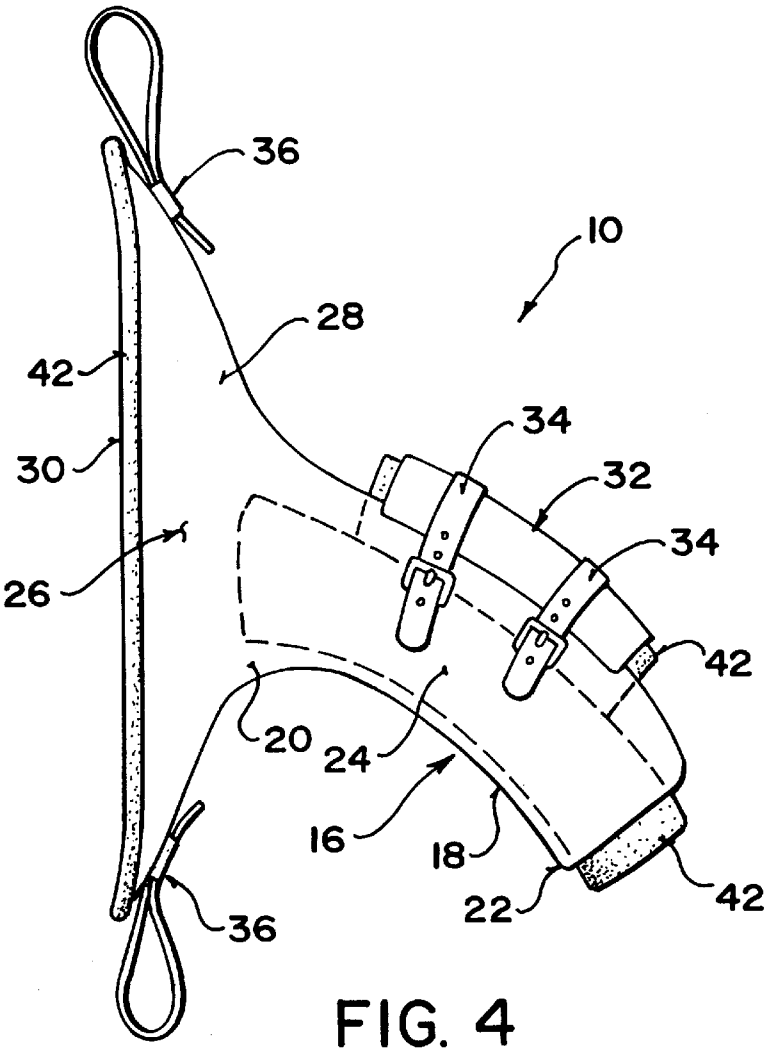
FIG. 4 is a side elevational view of the tail set of FIG. 1.

As illustrated in FIG. 5 the tail set 10 may be used in conjunction with a bustle 46 generally comprising a padded strap which is looped under the horses tail and supported on a rear end of the horse. When the tail set 10 is used in conjunction with the bustle 46, the trough 16 is inserted through an opening formed in the loop of the bustle 46 so as to provide rigid support to the tail 12 of the horse 14 in addition to the support of the bustle 46. The strap mounts 36 on the tail set are arranged similarly to the conventional bustle harnessing straps mounting the bustle 46 thereon such that the tail set and the bustle may be coupled together. When coupled together the lobes 26 of the tail set position the trough appropriately on the rear end of the horse while the trough 16 provides rigid lateral support to the tail to correct the tail of undesirable lateral deviations from the longitudinal direction of the horses back. The bustle 46 assists in supporting the weight of the tail 12 thereon. The tail set 10 however is generally able to adequately support the tail 12 of the horse within the trough 16 while the lobes 26 position the trough as desired on the rear end of the horse without the additional use of the bustle 46.

In use the tail set 10 is supported on the horse by bustle harnessing prior to being displayed and while in training to ensure that the tail is raised in elevation and aligned straight with the back of the horse. The tail set 10 thus comprises a therapeutic aid for the maintenance of the tail to correct lateral deviations thereof and to draw the tail in high elevation for enhancing the show appearance of the horse. The mounting of the trough ensures that there is no relative sliding movement with the tail. By holding the tail in higher elevation the tail break is enhanced. The lobes 26 of the tail set ensure stable mounting to achieve maximum benefits in tail correction by controlling lateral displacement thereof. The static mounting of the tail set on the horse further permits the tail set to be safely used post surgically.

While one embodiment of the present invention has been described in the foregoing, it is to be understood that other embodiments are possible within the scope of the invention. The invention is to be considered limited solely by the scope of the appended claims.

What is claimed is:

1. A tail set apparatus for supporting a tail of a horse, the apparatus comprising:

a rigid trough having a base along a bottom side thereof arranged to extend longitudinally from a first end to a second end of the trough, the trough including side members extending upwardly from respective sides of the base to extend longitudinally therewith so as to receive a portion of the tail of the horse extending through the trough from the first end to the second end securely between the respective rigid side members thereof, the trough being arched in the longitudinal direction from the first end to the second end thereof;

a support member having an outer surface mounting the first end of the trough thereon and an inner supporting surface opposite the outer surface, the inner supporting surface being oriented to span transversely to a longitudinal direction of the trough wherein at least a portion of the inner supporting surface is offset laterally outward from each side of the trough and at least a portion of the inner supporting surface is offset vertically from the first end of the trough so as to support the trough on a rear end of the horse to project outwardly therefrom when the inner supporting surface is engaged on the rear end of the horse;

a cap being arranged to be supported on the trough spaced from the base and spanning the side members so as to secure the tail of the horse between the cap and the base of the trough, the cap being arched in the longitudinal direction of the trough similarly to the trough for mating engagement with the trough; and a plurality of strap mounts mounted on the outer surface of the support member, each strap mount being arranged to secure a harness strap thereon wherein at least one strap mount is offset laterally from each side of the trough such that the trough is suspended from the strap mounts therebetween for supporting the trough on the horse.

2. The apparatus according to claim 1 wherein the side members of the trough extend upwardly to respective free ends which are parallel and spaced apart from each other.

3. The apparatus according to claim 1 wherein the support member comprises two lobes, each lobe extending laterally outward from a respective side of the trough.

4. The apparatus according to claim 3 wherein the lobes are spaced apart.

5. The apparatus according to claim 3 wherein the inner supporting surface of each lobe is generally concave.

6. The apparatus according to claim 1 wherein the support member is generally symmetrical about a vertical plane extending longitudinally with the trough.

7. The apparatus according to claim 1 wherein the base of the trough is spaced outwardly from the inner supporting surface of the support member.

8. The apparatus according to claim 1 wherein the support member spans both upward and downward from the first end of the trough.

9. A tail set apparatus for supporting a tail of a horse, the apparatus comprising:

a rigid trough having a base along a bottom side thereof arranged to extend longitudinally from a first end to a second end of the trough, the trough including side members extending upwardly from respective sides of the base to extend longitudinally therewith so as to receive a portion of the tail of the horse extending through the trough from the first end to the second end securely between the respective rigid side members thereof;

a support member having an outer surface mounting the first end of the trough thereon and an inner supporting surface opposite the outer surface, the inner supporting surface being oriented to span transversely to a longitudinal direction of the trough wherein at least a portion of the inner supporting surface is offset laterally outward from each side of the trough and at least a portion of the inner supporting surface is offset vertically from the first end of the trough so as to support the trough on a rear end of the horse to project outwardly therefrom when the inner supporting surface is engaged on the rear end of the horse;

a cap being arranged to be supported on the trough spaced from the base so as to secure the tail of the horse between the cap and the base of the trough, the cap having an inverted trough shape so as to form a generally tubular enclosure when mated with the trough;

the cap being hinged along one side of the trough on one of the side members of the trough so as to be pivotal relative to the trough for receiving the tail of the horse within the trough; and a plurality of strap mounts mounted on the outer surface of the support member, each strap mount being arranged to secure a harness strap thereon wherein at least one strap mount is offset laterally from each side of the trough such that the trough is suspended from the strap mounts therebetween for supporting the trough on the horse.

10. The apparatus according to claim 1 wherein the cap is arranged to fully enclose a top side of the trough when engaged thereon.

11. The apparatus according to claim 1 wherein at least one of the strap mounts is mounted on the support member offset upwardly from the first end of the trough.

12. The apparatus according to claim 1 wherein there is provided one strap mount spaced above the trough and one strap mount spaced below the trough offset laterally from each side of the trough.

13. The apparatus according to claim 12 wherein the support member comprises a pair of spaced apart lobes and wherein there is provided an adjustable strap member coupled therebetween spaced above the trough.

14. A tail set apparatus for supporting a tail of a horse, the apparatus comprising:

a rigid trough having a base along a bottom side thereof arranged to extend longitudinally from a first end to a second end of the trough, the trough including side members extending upwardly from respective sides of the base to extend longitudinally therewith so as to receive a portion of the tail of the horse extending through the trough from the first end to the second end securely between the respective rigid side members thereof, the trough being arched in the longitudinal direction from the first end to the second end thereof;

a support member having an outer surface mounting the first end of the trough thereon and an inner supporting surface opposite the outer surface, the inner supporting surface being oriented to span transversely to a longitudinal direction of the trough wherein at least a portion of the inner supporting surface is offset laterally outward from each side of the trough and at least a portion of the inner supporting surface is offset vertically from the first end of the trough so as to support the trough on a rear end of the horse to project outwardly therefrom when the inner supporting surface is engaged on the rear end of the horse;

a lining along an inner surface of the trough formed of resilient padded fibrous material; and a plurality of strap mounts mounted on the outer surface of the support member, each strap mount being arranged to secure a harness strap thereon wherein at least one strap mount is offset laterally from each side of the trough such that the trough is suspended from the strap mounts therebetween for supporting the trough on the horse.

15. The apparatus according to claim 1 wherein there is provided a lining along the inner supporting surface of the support member formed of resilient padded material.

16. The apparatus according to claim 1 wherein both the trough and the cap include a lining along an inner surface formed of resilient padded fibrous material.

17. The apparatus according to claim 9 wherein the cap is hinged by a set of flexible straps coupled between the cap and said one of the side members of the trough.

18. The apparatus according to claim 9 wherein the trough is arched in the longitudinal direction from the first end to the second end of the trough, the cap being arched in the longitudinal direction of the trough similarly to the trough for mating engagement with the trough.

19. The apparatus according to claim 14 wherein there is provided a cap being arranged to be supported on the trough spaced from the base so as to secure the tail of the horse between the cap and the base of the trough, the cap having a lining along an inner surface formed of resilient padded fibrous material.

20. A tail set apparatus for supporting a tail of a horse, the apparatus comprising:

a rigid trough having a base along a bottom side thereof arranged to extend longitudinally from a first end to a second end of the trough, the trough including side members extending upwardly from respective sides of the base to extend longitudinally therewith so as to receive a portion of the tail of the horse extending through the trough from the first end to the second end securely between the respective rigid side members thereof, the trough being arched in the longitudinal direction from the first end to the second end thereof;

a support member having an outer surface mounting the first end of the trough thereon and an inner supporting surface opposite the outer surface, the inner supporting surface being oriented to span transversely to a longitudinal direction of the trough wherein at least a portion of the inner supporting surface is offset laterally outward from each side of the trough and at least a portion of the inner supporting surface is offset vertically from the first end of the trough so as to support the trough on a rear end of the horse to project outwardly therefrom when the inner supporting surface is engaged on the rear end of the horse;

a lining along an inner surface of the trough formed of resilient padded fibrous material, the lining extending in the longitudinal direction of the trough past the second end of the trough; and a plurality of strap mounts mounted on the outer surface of the support member, each strap mount being arranged to secure a harness strap thereon wherein at least one strap mount is offset laterally from each side of the trough such that the trough is suspended from the strap mounts therebetween for supporting the trough on the horse.

* * * * *